United States Patent [19]

Hasegawa et al.

[11] Patent Number: 5,058,657

[45] Date of Patent: Oct. 22, 1991

[54] APPARATUS FOR CONTINUOUS CASTING OF METAL STRIP

[75] Inventors: Morihiro Hasegawa, Tokuyama; Takashi Yamauchi, Kudamatsu, both of Japan

[73] Assignee: Nisshin Steel Co., Ltd., Tokyo, Japan

[21] Appl. No.: 488,081

[22] PCT Filed: Jul. 21, 1989

[86] PCT No.: PCT/JP89/00733

§ 371 Date: Mar. 20, 1990

§ 102(e) Date: Mar. 20, 1990

[87] PCT Pub. No.: WO90/00947

PCT Pub. Date: Feb. 8, 1990

[30] Foreign Application Priority Data

Jul. 22, 1988 [JP] Japan ..... 183256

[51] Int. Cl.[5] ..... B22D 11/06

[52] U.S. Cl. ..... 164/428; 164/480

[58] Field of Search ..... 164/428, 480, 429, 479

[56] References Cited

U.S. PATENT DOCUMENTS 4,754,802 7/1988 Yamauchi et al. ..... 164/428

*Primary Examiner*—Kuang Y. Lin

*Attorney, Agent, or Firm*—Lowe, Price, Leblanc & Becker

[57] ABSTRACT

A twin roll continuous casting apparatus for continuously casting a metal strip through a gap of a pair of internally cooled rolls rotating in the opposite direction to each other having a pair of side dams disopsed on both sides of the rolls wherein each side dam comprises an upper dam which is made of an abradable refractory and forcibly fed in the casting direction and a movable lower dam which is disposed near the narrowest position of the rolls and caused to move synchronously with the strip being cast in the same direction, whereby the casting proceeds while bottom surfaces of both the upper dams are abrasively worn by circumferential surfaces of the rolls.

2 Claims, 4 Drawing Sheets

APPARATUS FOR CONTINUOUS CASTING OF METAL STRIP

TECHNICAL FIELD OF THE INVENTION

The present invention relates to an improvement in a twin roll continuous casting apparatus for continuously casting a metal strip directly from a molten metal such as a molten steel.

BACKGROUND OF THE INVENTION

Well known in the art is a so-called twin roll continuous casting apparatus in which a pair of internally cooled rolls having respective horizontal axes and rotating in opposite direction to each other are disposed parallel to each other with an appropriate gap therebetween, a pool of molten metal is formed on the circumferential surfaces (the upper halves of cylindrical surfaces in the axial directions) of the rolls above the gap and the molten metal is continuously cast into a metal strip through the gap while being cooled by the circumferential surfaces of the rotating rolls. There has also been proposed such a twin roll continuous apparatus applied to a case of continuous casting of steel to produce a steel strip directly from molten steel.

When a metal strip is continuously cast through a gap between a pair of rolls, it is necessary to form a pool of molten metal on the circumferential surfaces of the pair of rolls above the gap therebetween and to maintain a level of the molten metal in the pool substantially constant by continuously pouring the molten metal into the pool. In order to form the pool of molten metal, there are required a pair of dams having their surfaces perpendicular to the roll axes which prevent an overflow of molten metal along the roll axes on the circumferential surfaces of the rolls. These dams also serve usually to regulate the width of the cast strip and are referred to herein as "side dams". In addition to the side dams disposed at the left and right sides of the rolls, a pair of front and rear gates having their surfaces along the roll axes may be erected orthogonally to the side dams on the circumferential surfaces of the rolls so as to form a box-like pool for molten metal with the side dams and the front and rear gates. However, when the pair of rolls have sufficiently large radii respectively, the front and rear gates along the roll axes are not always needed. In this case, the circumferential surfaces of the pair of rolls may fulfill by themselves roles of the front and rear gates.

There are known, as the pair of side dams, movable side dams which urge a pair of endless metal belts, caterpillars and the like against both edge surfaces of the rolls (side surfaces of the rolls perpendicular to the roll axes) at a location of the roll gap and move at a speed corresponding to the casting speed, and fixed side dams which have plate-like bodies of refractories fixed to left and right side surfces of the rolls. Generally, with the latter fixed side dams, the constitution of the apparatus is simple and the control of running is not complicated, compared with the former movable side dams.

Two systems of the fixed side dams are known. One is a system in which the distance between the plate-like bodies of the fixed side dams is smaller than the roll width (the length of roll from one end to the other end), and the other is a system in which the distance is the same as the roll width. According to the former system, the pair of side dams are erected on the circumferential surfaces of the rolls such that the bottoms of the side dams slidably contact the circumferential surfaces of the rolls. According to the latter system, the side dams are fixedly provided so that the respective inside surfaces of the side dams slidably contact the side surfaces of the rolls, that is, the pair of side dams sandwich the pair of rolls on the side surfaces of the rolls.

Usually, the fixed side dams are made of refractory material having a good adiabatic property. This is because the molten metal contacting the side dams has to be prevented from being solidified on the surfaces of the side dams. Adiabatic refractory materials generally have inferior wear resistance to that of solidified metal and liable to have scratches. Thus, the fixed refractory side dams may be damaged during the running of the apparatus, and the increase of damages may bring about break-out of molten metal. Further, according to the system noted above in which the side dams are fixed so that they sandwich the rolls on their side surfaces, clearances may be formed between the side surfaces of the rolls and the inside surfaces of the side dams slidably contacting therewith due to pressure of the ends of the strip being cast applied at the time of passing through the roll gap, and the molten metal may enter the clearances. If such troubles occur, stable casting may no longer be continued. Accordingly, it has generally been considered that refractory materials suitable for the side dams should have a good wear resistance and the highest possible strength.

During the continuous casting, a portion of molten metal in the pool forms thin solidified shells respectively on the surfaces of the rotating rolls, and then these shells pass through the gap between the twin rolls while growing along with rotation of the rolls. At this time, the solidified shells are depressed (rolled) at a portion in the neighborhood of the smallest gap between the rolls to form into a metal strip of a predetermined thickness. Thus, owing to this depression (rolling), the solidified shells tend to expand widthwise near the roll gap. As a result, the ends of the cast strip apply large pressure to the side dams. In the case of the movable side dams wherein the side dams are moved at a speed corresponding to the casting speed, a problem of friction between the side dams and the ends of of the cast strip is not substantially posed. In the case of the fixed side dams, however, large friction is inevitably generated between the ends of the moving cast strip and the fixed side dams, and can be a cause of damages of the refractory side dams, occurrence of cracking and undesirable deformation of the ends of the cast strip, formation of clearances between the side surfaces of the rolls and the inside surfaces of the side dams slidably contacting therewith, and entrance of molten metal into the clearances so formed, all of which hinder stable continuous casting. These problems are especially serious in the case of continuous casting of steel wherein the material involved is higher melting and has higher strength, when compared with cases wherein lower melting and mild non-ferrous metals are concerned.

In Japanese Patent Application No. 62-84,555 (published as JP A-63-252,646 on Oct. 19, 1988, after the priority date of the present international application, that is, July 22, 1988; the corresponding U.S. patent application was issued as U.S. Pat. No. 4,811,780 on Mar. 14, 1989.), we have proposed a continuous casting apparatus for metal strip which may be said "abradable dam system" or "semi-movable dam system" intermediate between "movable" and "fixed" dam systems. According to our prior proposal. a refractory material capable of being well abraded is used as the material for the side dams, contrary to the prior art concept that refractory materials suitable for the side dams should have a good wear resistance and the highest possible strength. The abradable side dams are forcibly fed or moved in the casting direction during the casting while being frictionally abraded by slidably contacting surfaces of the rotating rolls and ends of the strip being cast. Repeated runs of continuous casting by the abradable dam system have indicated that further improvements are desired for a further stable running of continuous casting.

In Japanese Patent Application No. 61-21,4853 (published as JP A-62-214,863 before the priority date of the present international application; the corresponding U.S. patent application was issued as U.S. Pat. No. 4,754,802 on July 5, 1988.), we proposed a continuous casting apparatus for metal strip in which a pair of side dams are used, each side dam comprising a combination of a fixed dam which is not abradable) and a movable dam which is a movable belt. According to this prior art, the fixed side dams of a non-abradable refractory material are disposed above the narrowest position of the rolls, and the movable side dams are disposed below the fixed side dams. Our later experiences have revealed that the above-discussed problem of damages of fixed dams is also associated with this system of a combination of fixed dams and movable dams.

OBJECT OF THE INVENTION

An object of the invention is to provide an apparatus for continuously casting a metal strip which utilizes advantages of both the abradable dam system and the combined fixed dam and movable dam system which we have previously proposed and which can ensure a further stable continuous casting.

DISCLOSURE OF THE INVENTION

An apparatus for continuously casting a metal strip according to the invention comprises a pair of internally cooled rolls rotating in the opposite direction to each other and disposed parallel to each other and a pair of side dams disposed on both sides of the pair of rolls for forming a pool of molten metal on the circumferential surfaces of the pair of rolls, thereby continuously casting the molten metal in the pool into a metal strip through a gap between the pair of rolls, characterized in that each of said side dams is constituted from a combination of an upper dam which is made of a refractory material capable of being well abraded with a lower dam which is an endless metal belt; the upper dams are disposed so that at least a portion of the bottoms may contact the circumferential surfaces of the pair of rolls so as to allow at least a portion of a thickness of each upper dam to be located on the circumferential surfaces of the rolls; mechanisms are provided for feeding the upper dams in the casting direction at a predetermined speed; at least a portion of circumferential surfaces of the rolls contacting the upper dams are formed into rough surfaces having an abrading ability; the lower dams which are endless metal belts are disposed on portions of side surfaces of the rolls including the narrowest position of the rolls; and mechanisms are provided for circularly moving the lower dams at a speed substantially synchronized with the casting speed.

In an embodiment wherein the upper dams are disposed so that a portion of a thickness of each upper dam may be located on the circumferential surfaces of the rolls and the remaining portion of the thickness of the same upper dam may extend beyond side edges of the rolls, outer surfaces of the downward moving upper dams slidably contact with inner surfaces of the lower dams in the proximity of the narrowest position of the rolls. In this embodiment, the inner surfaces of the lower dams which slidably contact the upper dams are formed into rough surfaces having an abrading ability. In an embodiment wherein the upper dams are disposed so that all of the thickness of each upper dam may be located on the circumferential surfaces of the rolls, the inner surfaces of the lower dams are not necessarily formed into rough surfaces having an abrading ability.

DETAILED DESCRIPTION OF THE INVENTION

The invention will now be described in detail with reference to the drawings.

Figure 1:
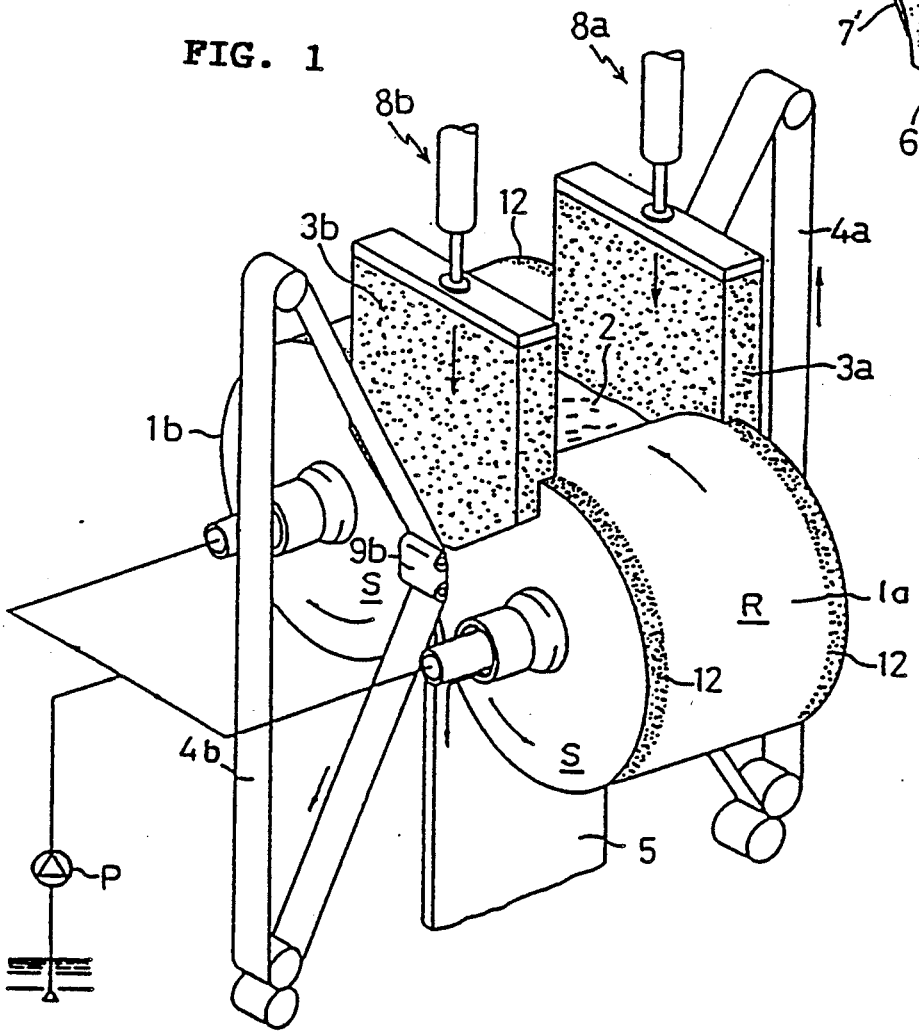
FIG. 1 is a perspective view showing principal portions of an embodiment of the apparatus according to the invention.

Referring to FIG. 1, reference numerals 1*a*, 1*b* designate a pair of internally cooled rolls rotating in the opposite direction to each other (the rotational directions of both rolls are shown by arrows) and opposed parallel to each other with their roll axes held horizontally. Reference numeral 2 designates a molten metal in a pool formed on the circumferential surfaces R of the pair of rolls 1*a*, 1*b*. Reference numerals 3*a*, 3*b* designate side dams made of an abradable refractory material (upper dams to be abraded), 4*a*, 4*b* side dams each comprising an endless metal belt (lower dams) and 5 a cast strip, respectively.

In either of the illustrated embodiments the rolls 1*a*, 1*b* are internally cooled with water. More specifically, the rolls 1*a*, 1*b* are formed on the inside of drums constituting the circumferential surfaces R with cooling water paths (not shown). The circumferential surfaces R are adapted to be cooled to a predetermined temperature by water passing through the cooling water paths. Cooling water is supplied to and drained from the cooling water path on the inside of the circumferential surface R through a shaft of each roll. Thus, the roll shaft is of a double pipe structure with an inner pipe serving as a supply pipe and an annular pipe path formed between outer and inner pipes serving as a drain pipe. In the interior of the roll, the cooling water supply pipe which is the inner pipe is connected to an inlet of the cooling water path provided inside the circumferential surface R, while the annular pipe path is connected to a cooling water outlet. When cooling water is continuously supplied from a pump P into the inner pipe as shown in FIG. 1, the supplied cooling water is circulated through the cooling water path located inside the circumferential surface R and then drained through the annular pipe path. The illustrated apparatus is constructed so that the operation of passing cooling water may be carried out even in the running of the apparatus.

Figure 2:
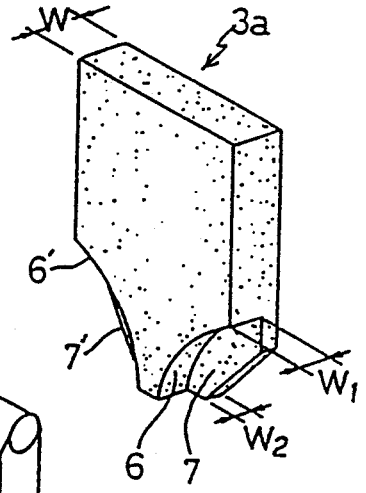
FIG. 2 is a perspective view showing an example of a shape of the upper dam in the apparatus of FIG. 1.

The upper dams 3*a*, 3*b* are made of an abradable refractory material, and each may have a shape as shown in FIG. 2. The illustrated upper dam 3*a* comprises unitary formed inner and outer portions. Of the whole thickness W of the dam, a thickness of $W_1$ is possessed by the inner portion to be installed on the circumferential surface R of the roll, while the remaining thickness of $W_2$ is possessed by the outer portion to be installed out of the circumferential surface R of the roll. Namely, the inner portion of a thickness of $W_1$ has bottom surfaces 6, 6′ worked to have curved surfaces corresponding to the circumferential shapes of the rolls 1*a*, 1*b* and the outer portion of a thickness of $W_2$ is shaped to have inner surfaces 7, 7′ slidably contacting the side surfaces S (see FIG. 1) of the rolls 1*a*, 1*b* and extending beyond the bottom surfaces 6, 6′ of the inner portion. FIG. 1 depicts the apparatus according to the invention in which the refractory upper dams 3*a*, 3*b* each having a shape as shown in FIG. 2 are installed so that the curvedly worked bottom surfaces 6, 6′ of the inner portions having a thickness of $W_1$ may contact the circumferential surfaces R of the rolls 1*a*, 1*b* and the inner surfaces 7, 7′ of the outer portions having a thickness of $W_2$ may slidably contact the side surfaces S of the rolls 1*a*, 1*b*. During the running of the apparatus, the upper dams 3*a*, 3*b* are forcibly fed in the casting direction (downward) by means 8*a*, 8*b*. Frames (not shown are provided for supporting the upper side dams and keeping the direction of downward feeding thereof. Systems which can be used herein for lowering the upper side dams 3*a*, 3*b* include a screw drive system utilizing rotation energy of motor, a rack-and-pinion system, and a cylinder-piston system utilizing oil or air pressure. By this downward feeding of the upper side dams 3*a*, 3*b*, they are abrasively worn at the bottom surfaces 6, 6′ by edge portions 12 of the circumferential surfaces of the rolls. Materials constituting the upper side dams 3*a*, 3*b* should be not only adiabatic enough to prevent the molten metal from being solidified on inside surfaces of the upper side dams 3*a*, 3*b*, but also capable of being abraded by rough surfaces 12 of the circumferential surfaces of the rolls 1*a*, 1*b*. Further, they are preferably properly abraded by ends of the strip being cast. Examples of such suitable materials include, for example, adiabatic bricks, ceramic fiber boards and boron nitride (BN) which have good abradability, that is, an ability of capable of being well abraded. A system of continuously lowering the upper side dams is preferably used in a mechanism for moving the upper side dams downward. However, an intermittent moving system for repeatedly lowering and stopping the upper side dams may also be used, depending on particular cases.

The lower side dams 4*a*, 4*b*, which are movable dams, comprises endless metal belts made of a metal having a good heat conductivity such as steel alloys and copper based alloys. The endless metal belts 4*a*, 4*b* are pressed against the roll side surfaces by belt back-ups 9*a*, 9*b* respectively so that they may seal the narrowest roll gap below the upper side dams 3*a*, 3*b*, and may be caused to circularly move to pass the narrowest position of the rolls downward.

Figure 3:
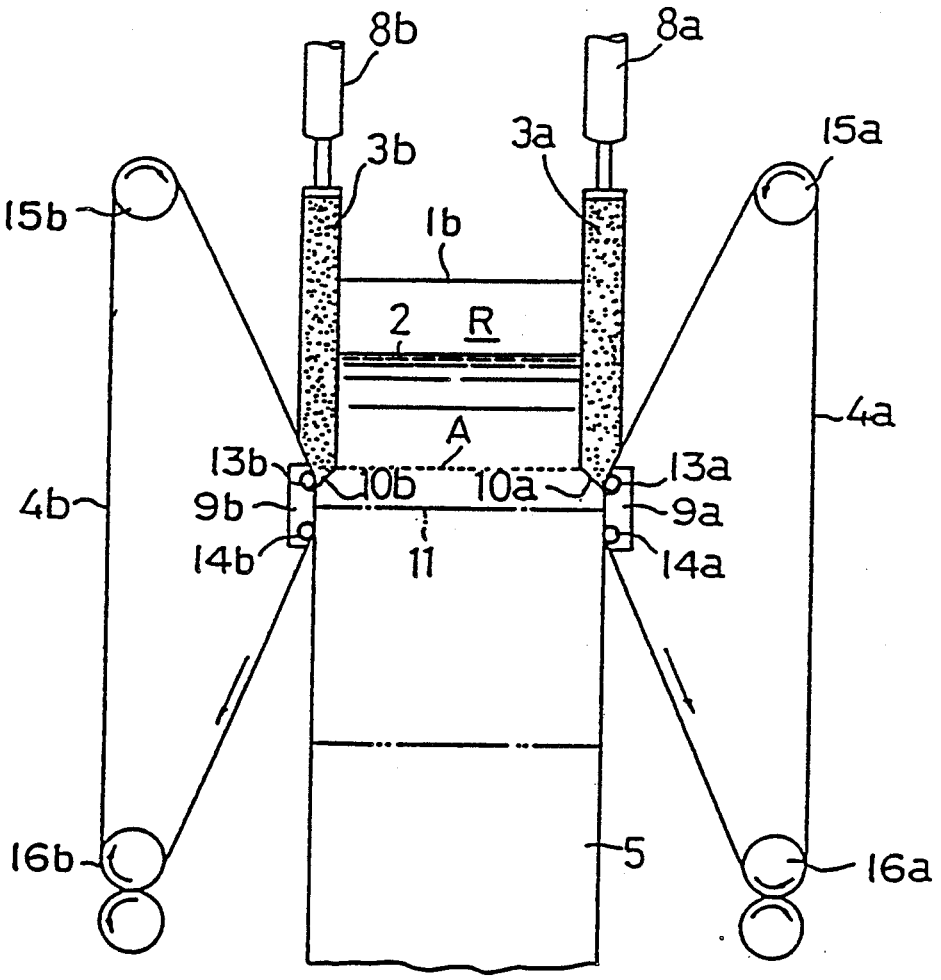
FIG. 3 is a schematic cross-sectional view of the apparatus of FIG. 1 showing a state of casting, as viewed in the plane of the cast strip.

FIG. 3 depicts a vertical cross-section of the apparatus of FIG. 1 along the narrowest roll gap parallel to the roll axes. As shown in FIG. 3, the belt back-ups 9*a*, 9*b* are disposed so that they cover lower edges 10*a*, 10*b* of the portions of the upper side dams 3*a*, 3*b* having a thickness of $W_1$. In other words, the belt back-ups 9*a*, 9*b* are disposed so that the endless metal belts 4*a*, 4*b* may slidably contact the outside surfaces of lower parts of the upper side dams 3*a*, 3*b*. In FIG. 3 a reference numeral 11 designates the position of the narrowest roll gap of the rolls, and reference numerals 13*a*, 13*b* and 14*a*, 14*b* designate idle rolls of a small diameter attached to the belt back-ups 9*a*, 9*b* for facilitating the movement of the endless metal belts 4*a*, 4*b*. The endless metal belts 4*a*, 4*b* are driven by a motor or motors (not shown) via upper and lower guide rollers 15*a*, 15*b* and 16*a*, 16*b*, but they are not restricted to a particular number of the guide rollers and a particular shape of the loop. The moving speed of the endless metal belts 4*a*, 4*b* is preferably synchronized with the peripheral speed of the pair of rolls. But exact synchronization is not always necessary. Surfaces of the endless metal belts 4*a*, 4*b* coming in contact with the upper side dams 3*a*, 3*b* are preferably formed into rough surfaces so that the upper side dams 3*a*, 3*b* may be properly abraded. A level shown by a symbol A in FIG. 3 depicts a position where the solidification of shells is completed.

Portions of the circumferential surfaces of the rolls slidably contacting the bottom surfaces 6, 6′ of the upper side dams 3*a*, 3*b* are preferably formed into rough surfaces having an abrading ability. The rough surface portions (4 portions) are designated by reference numeral 12 in FIG. 1. If the roughness and hardness of the portions 12 are properly selected according to the material of the upper side dams 3*a*, 3*b* and casting conditions, abrasion of the bottom surfaces 6, 6′ of the upper side dams 3*a*, 3*b* adequately proceeds during casting. It is desirable that the adequate abrasion conditions are stationary and do not change with time. The portions 12 may be made of the same material as the material constituting the entire circumferential surfaces R of the rolls that have been roughened by emery polish or sand blasting. However, the material of the circumferential surfaces R of the rolls is inherently selected in consideration of required thermal conductivity and formation of sound solidified shells. Accordingly, it is often advantageous to form the rough surfaces of a material other than that of the circumferential surfaces R on the portions 12 instead of roughening surfaces of the portions 12 of the circumferential surfaces R. For example, the portions 12 of the circumferential surfaces R may be provided with layers of a hard material, and surfaces of such layers may be roughened to impart them an abrading ability. The layers of a hard material may be formed by plating with a hard metal such as Ni and Ni-base alloys, Ni-Fe alloys. Cr and Cr-base alloys and Fe alloys; or by flame spraying of a hard metal such as Ni-Cr alloys, carbon steels and stainless steels, a ceramic such as $Cr_2O_3$, $TiO_2$, $Al_2O_3$ and $ZrO_2$, or a cermet such as $ZrO_2$-NiCr, $Cr_3C_2$-NiCr and WC-Co. In cases wherein layers of a hard material are formed by flame spraying, if flame spray coatings are built under such conditions that surface depressions and extrusions may be naturally formed by deposition of flame sprayed particles, the resulting flame spray coatings as such have roughened surfaces having an abrading ability. The roughening procedures described above may also be applied to those surfaces of the endless metal belts 4a, 4b which are to slidably contact the upper dams 3a, 3b.

Figure 4:
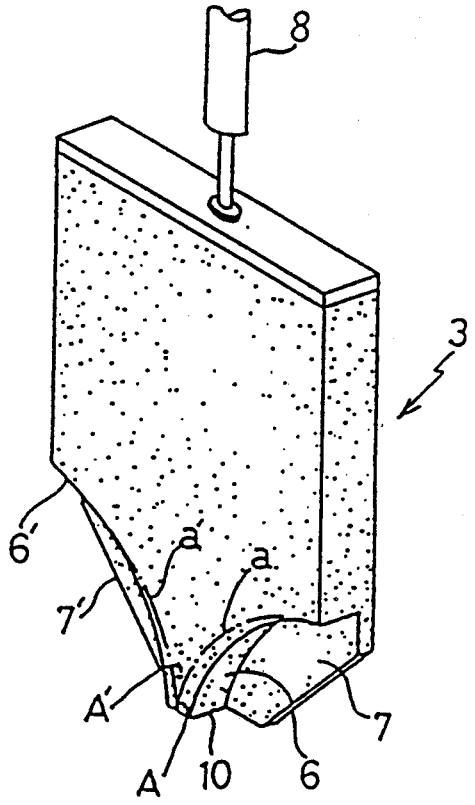
FIG. 4 is a perspective view of the upper dam in the apparatus of FIG. 1 under the condition where the degree of abrasion of the dam is small at an early stage of the casting process.

FIG. 4 shows the internal surface condition of the upper dam according to the invention at an early stage of the casting process. Side ends of solidified shells formed on the respective surfaces of the internally cooled rolls contact the internal surface of the upper dam on the levels shown by reference symbols a, a' in FIG. 4, and are combined together at point A. That is, a portion of molten metal in the pool is cooled on the surface of each roll and then solidified to thin shells. The solidified shells so formed on the surfaces of the respective rolls grow and combine together along with the rotation of the rolls, and the combined shells are rolled through the gap between the rolls to a predetermined thickness. During the course of this, ends of the solidified shells come in contact with the internal surface of each upper dam on the level shown by a, a'. The initial configuration of the upper side dam (before it is abraded by running of the apparatus) is preferably determined such that the confluence A of the solidified shells (the position where the solidification of the shells is completed) will be located below the lower edge 10 of the upper side dam. However, during the casting process, the confluence A may be moved to a position A' above the position of the lower edge 10 due to variations in casting conditions. In this case, the widthwise expansion of the strip (the solidified metal strip which has passed the confluence) will abrade the corresponding (lower edge) portions of refractories. Unless the upper side dams are lowered under such conditions, the strip width is gradually increased. If the strip width exceeds the roll width, the strip formed may have a dog bone like cross-section with ends coming from the exceeding portions swollen, and in the further proceeding of casting, the side dams will be damaged, resulting in breakout of molten metal. Such situations can be avoided with the apparatus according to the invention, in which the upper dams of an abradable refractory material are lowered at a predetermined speed, and thus, new surfaces of the upper dams are successively lowered even if the edge portions of the upper dams are abraded off by the ends of the strip being cast. Furthermore, the endless metal belts which urge the lower edge portions 10a, 10b of the upper upper dams from the outside and are caused to move substantially in the casting direction, not only further serve to avoid the above-mentioned undesirable situations but also promote rapid cooling and solidification of side edges of the strip being cast.

Figure 5:
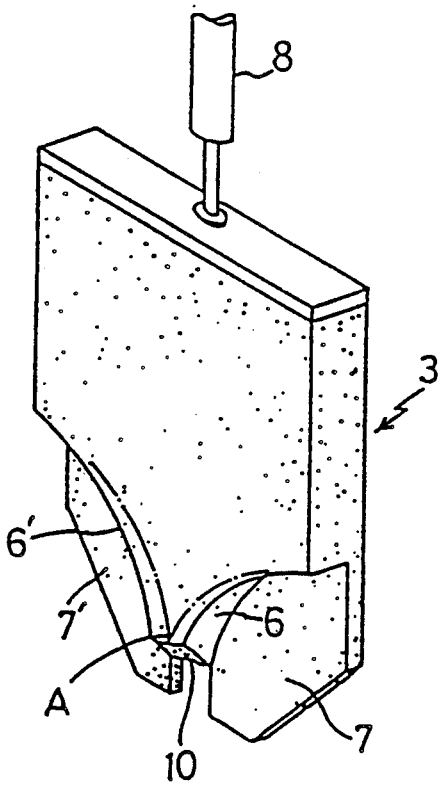
FIG. 5 is a perspective view of the upper dam in the apparatus of FIG. 1 under the condition where the degree of abrasion of the dam is proceeded in the casting process.

FIG. 5 shows the internal surface of the upper dam when it has been considerably lowered in the proceeding of casting. While the bottom surfaces 6, 6' and the lower edge 10 have been abraded by the rough surfaces 12 of the rolls and the side ends of the cast strip, respectively, and their positions have moved upward relative to the initial positions shown in FIG. 4, the lower edge 10 has been abraded by the strip ends into the somewhat slant condition. In the apparatus according to the invention there is provided an inside surface of the moving endless metal belt in such a manner that it covers a back surface of the lower edge 10 and regions below the lower edge 10. Accordingly, the moving inside surface of the endless metal belt prevents any possible leakage of molten metal which might take place due to abrasion of the lower edge 10 of the upper dam and acts to cool ends of the strip being cast to promote rapid solidification. By forming the moving inside surface of the endless metal belt into a rough surface, the portion of the upper dam having a thickness of $W_2$ is abraded off below the lower edge 10, making a chance of direct contact of ends of the strip being cast with the inside surface of the belt to further promote cooling of the strip ends. Moreover, the metal belt backs up to reinforce the lower edge portion 10 of the upper dam, preventing it from being damaged and making it possible for the lower edge portion 10 of the upper dam to keep its normal shape even when it receives an extraordinary pressure from the strip ends for some reasons.

Figure 6:
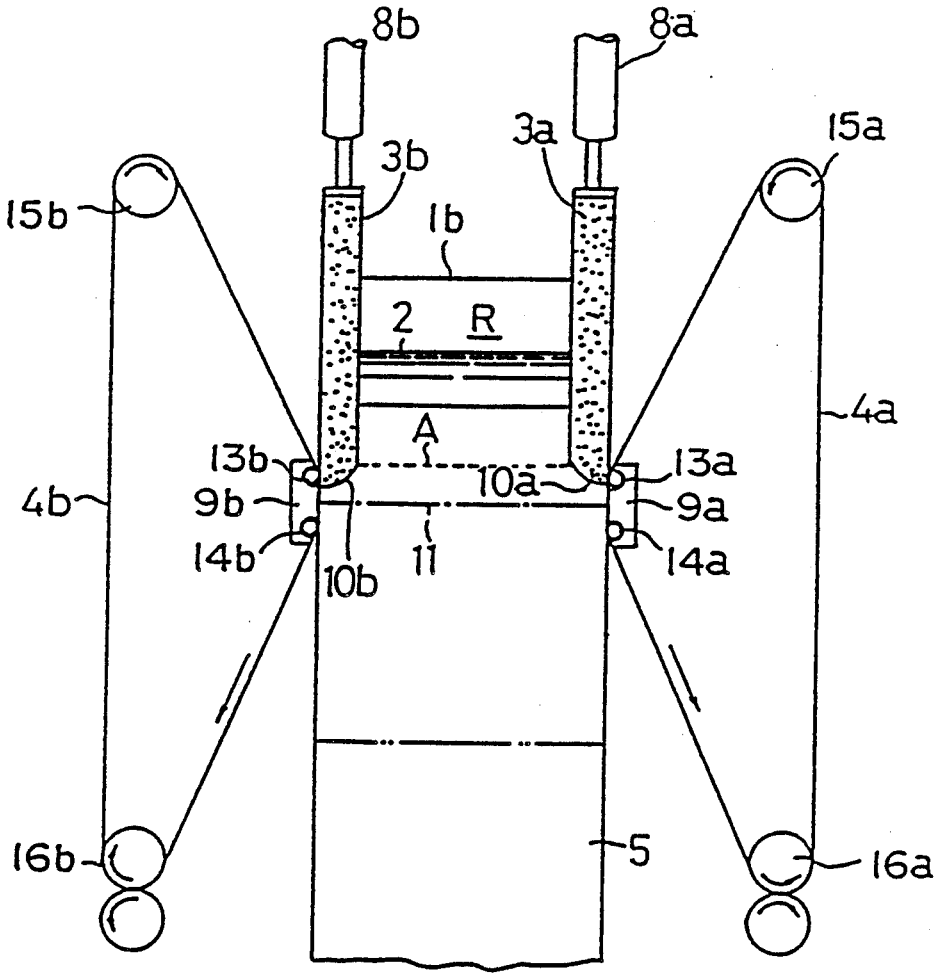
FIG. 6 is a schematic cross-sectional view of another embodiment of the apparatus according to the invention, as viewed in the plane of the cast strip.

FIG. 6 shows an apparatus according to the invention which is substantially the same as that shown in FIGS. 1 and 3, except that the whole thickness of the upper dams 3a, 3b are erected on the circumferential surfaces of the rolls. In the illustrated apparatus, the upper dams 3a, 3b are erected with the whole thickness on the circumferential surfaces R of the rolls so that outside surfaces of the upper dams respectively coincide with the side surfaces S of the rolls. In this case, the moving endless metal belts 4a, 4b, which are respectively guided by the belt back-ups 9a, 9b to cover the narrowest gaps between the rolls, may slidably contact the upper dams 3a, 3b which are descending. But it is not necessary for them to abrade the upper dams. Thus, the surfaces of the endless metal belts 4a, 4b which slidably contact the upper dams are not necessarily formed into rough surfaces. However, they may be made roughened as a countermeasure to a case wherein the lower edge portions 10 of the upper dam 3a, 3b might be pushed out for some reasons. Again in the example of FIG. 6, the endless metal belts back up to reinforce the lower portions (lower edges 10) of the upper dam 3a, 3b, and cool the ends of the strip which may be expanded widthwise below the lower edges 10, and prevent leakage of molten metal when such an emergency may happen, as is the case with the apparatus of FIG. 3 (FIG. 1).

As described herein, the apparatus according to the invention in which the upper dams composed of an abradable refractory material are forcibly lowered, while being abraded during the casting, and in which the movable lower dams comprising endless metal belts disposed just below the upper dams reinforce the lower portions of the upper dams and cool the ends of the strip being cast to promote solidification of the strip, effectively prevents damages of the side dams and leakage of molten metal around the side dams in twin roll casting apparatus, and ensures good quality of the ends of the strip, whereby stable continuous casting may be carried out.

We claim:

1. An apparatus for continuously casting a metal strip comprising a pair of internally cooled rolls rotating in the opposite direction to each other and disposed parallel to each other and a pair of side dams disposed on both sides of the pair of rolls for forming a pool of molten metal on the circumferential surfaces of the pair of rolls, thereby continuously casting the molten metal in the pool into a metal strip through a gap between the pair of rolls, characterized in that each of said side dams is constituted from a combination of an upper dam which is made of a refractory material capable of being well abraded with a lower dam which is an endless metal belt; the upper dams are disposed so that at least a portion of the bottoms may contact the circumferential surfaces of the pair of rolls so as to allow at least a portion of a thickness of each upper dam to be located on the circumferential surfaces of the rolls; mechanisms are provided for feeding the upper dams in the casting direction at a predetermined speed; at least a portion of circumferential surfaces of the rolls contacting the upper dams are formed into rough surfaces having an abrading ability; the lower dams which are endless metal belts are disposed on portions of side surfaces of the rolls including the narrowest position of the rolls; and mechanisms are provided for circularly moving the lower dams at a speed substantially synchronized with the casting speed.

2. The apparatus for continuously casting a metal strip according to claim 1 wherein the upper dams are disposed so that a portion of a thickness of each upper dam may be located on the circumferential surfaces of the rolls and the remaining portion of the thickness of the same upper dam may extend beyond side edges of the rolls; and those surfaces of the endless metal belts which slidably contact the upper dams are formed into rough surfaces having an abrading ability.

* * * * *